United States Patent [19]

Bach et al.

[11] 4,164,838

[45] Aug. 21, 1979

[54] PROCESS FOR THE PRODUCTION OF SYNTHETIC ENDLESS FILAMENTS WITH GOOD CRIMPING PROPERTIES

[75] Inventors: Hans Bach, Dormagen; Karl-August Heinroth; Hans-Dieter Jurischka, both of Dormagen-Horrem; Hans Kaloff, Zons, Neuss; Rudolf J. Klee; Herbert Schmidt, both of Dormagen, all of Fed. Rep. of Germany

[73] Assignee: Bayer Aktiengesellschaft, Leverkusen, Fed. Rep. of Germany

[21] Appl. No.: 530,445

[22] Filed: Dec. 6, 1974

[30] Foreign Application Priority Data

Dec. 6, 1973 [DE] Fed. Rep. of Germany ..... 2360707

[51] Int. Cl.[2] ..... D02G 1/02

[52] U.S. Cl. ..... 57/247; 57/288

[58] Field of Search ..... 57/34 HS, 157 TS, 140 R, 57/247, 287, 288

[56] References Cited

U.S. PATENT DOCUMENTS

| | | | |
|---|---|---|---|
| 3,535,866 | 10/1970 | Tsuruta et al. | 57/34 HS |
| 3,581,487 | 6/1971 | Loomes et al. | 56/34 HS |
| 3,816,988 | 6/1974 | Heinroth et al. | 57/34 HS |
| 3,874,159 | 4/1975 | Mac Farlane | 57/157 TS |
| 3,886,722 | 6/1975 | Hori et al. | 57/157 TS |

*Primary Examiner*—John Petrakes

*Attorney, Agent, or Firm*—Plumley & Tyner

[57] ABSTRACT

The invention is related to a process for the stretch-texturing of high-molecular weight linear synthetic endless filaments travelling at speeds of 300 to 1200 meters per minute by continuously guiding the filaments through a delivery zone, a heat-fixing zone, a false-twister and a stretching godet. The endless filaments are passed through a stretching zone S 55 to 180 cm long, defined by the distance between the delivery stage and the stretching godet, the distance between the delivery stage and the false-twister inlet amounting to S-X cm and the distance X between the false-twister outlet and the stretching godet being 5 to 30 cm.

6 Claims, 1 Drawing Figure

Figure 1:
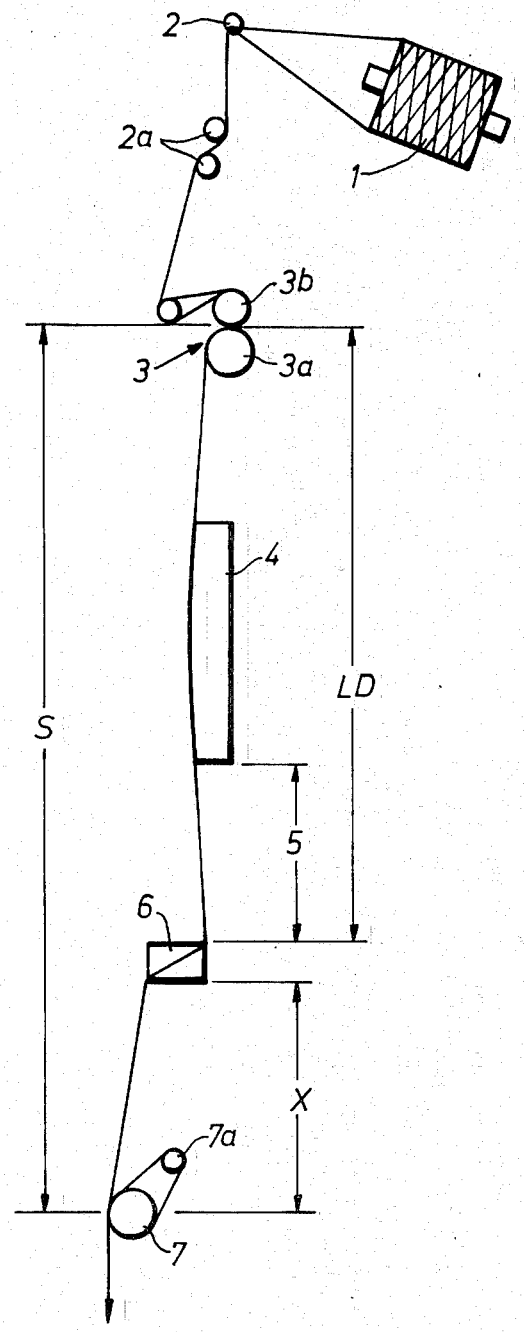

PROCESS FOR THE PRODUCTION OF SYNTHETIC ENDLESS FILAMENTS WITH GOOD CRIMPING PROPERTIES

This invention relates to a process for the simultaneous stretch-texturing of high-molecular-weight, linear synthetic endless filaments by the false-twist method at filament speeds of from 300 to 1200 metres per minute by continuously guiding the filaments through a delivery zone, a heat-fixing zone, a false-twister and a stretching godet.

False-twist yarns can be produced both by texturing previously stretched filaments and by simultaneous stretching and texturing. In the second of these two processes, known as simultaneous stretch-texturing, the unstretched filament enters the actual stretch-texturing zone, consisting of a delivery stage, a heat-fixing zone, a cooling zone, a false twister and a stretching godet. The twister gives the filament a twist between the delivery zone and the twister. The twist applied to the filament is fixed in the heat-fixing zone. At the same time, the filament is stretched, primarily on the heat-fixing element. Processes of this kind are described for example in German Offenlegungsschrift No. 2,049,357 and No. 2,200,427, in British Pat. No. 777,625 and in Austrian Pat. No. 202,690.

Examination of the crimping geometry of the individual filaments between the delivery stage and the twister, reveals one of the major disadvantages of the false-twist method, particularly in simultaneous stretch-texturing as described in the above-mentioned publications. When the filament is stretched and twisted at the same time, the filaments in the outer layers are subjected to a different stretch and strain from the filaments in the inner layers. This results in an increase in the tendency of the yarn to get filament breaks which can only be avoided by reducing the degree of stretch at the expense of tensile strength.

In addition, the aforementioned disadvantages become more serious at higher texturing speeds due to the increased lengths of the stretching zone which then have to be used as a result of the increased lengths of the heating rail and cooling zone.

The object of the invention is to avoid the disadvantages mentioned above.

It has now been found that these disadvantages can be avoided by guiding the endless filaments through unusually short stretching zones defined in length by the distance between the delivery stage and the stretching godet, the distances between the delivery stage and the false-twister inlet and between the false-twister outlet and the stretching godet being in a specific relationship to the length of the stretching zone.

Accordingly, the invention provides a process for the stretch-texturing of high-molecular-weight, linear synthetic endless filaments travelling at speeds of 300 to 1200 meters per minute by continuously guiding the filaments through a delivery zone, a heat-fixing zone, a false-twister and a stretching godet, wherein the endless filaments are passed through a stretching zone S 55 to 180 cm long, defined by the distance between the delivery stage and the stretching godet, the distance between the delivery stage and the false-twister inlet amounting to S-X cm and the distance X between the false-twister outlet and the stretching godet being 5 to 30 cm.

The length of the stretching zone through which the endless filaments pass is preferably from 80 to 120 cm, whilst the distance between the delivery stage and the false-twister inlet is from 65 to 105 cm.

Short stretching-zones can only be employed with correspondingly short heat-fixing zones and short cooling zones. However, short heat-fixing zones 30 to 70 cm long demand very high heating-element temperatures with respect to the filament at high filament speeds, so that precision guiding of the filament, which is possible only at considerable expense, is required for uniformity of temperature in the filament. On the other hand, short heat-fixing zones provide for a specific position of the stretching point, and for a reduced fall in filament tension along the heating element, in other words for an improvement in filament migration and hence for compensation for the problems caused by the irregularity of the crimping geometry of the individual filaments, such as excessive mechanical stressing of the outer filaments and necessary reduction of the degree of stretch with a corresponding deterioration in the crimp stability. A further consequence of short stretching-zones is a reduction in the evaporation of some volatile constituents of the spinning preparation and, hence, a reduction in mutual filament friction, in other words an improvement in filament migration.

Short cooling zones can be achieved by water cooled contact coolers or appropriately designed air nozzles, in other words, after the endless filaments have left the heat-fixing zone, they are preferably passed through a contact cooler 20 to 50 cm long. Where air nozzles are used, the cooling zone is preferably 3 to 15 cm long.

However, it should be noted that it is not the lengths of the cooling zone and heating rails which are primarily responsible for the advantages of the process described further below, but rather the distance between the delivery stage and the twister inlet which, because the filament is stretched in this region, should be regarded as the actual stretching zone. When it is in the stretching zone, the filament can be regarded as a torsion bar spring, in other words for a constant torque applied to the filament by the twister, the angle of rotation is proportional to the length of the torsion bar spring; inevitable fluctuations in the torque applied by the twister to the filament, especially in the case of friction twisters, are reflected in greater changes in the angle of rotation for greater lengths (greater slip between the filament and twister). Accordingly, stretching zone lengths greater than those according to the invention will result on the one hand in heavier mechanical stressing of the filament and on the other hand in greater instability of the twisted length of yarn which, in turn, is reflected in an unstable stretching point, in irregular filament migration and in uneven twisting (crimping).

The ratio of filament tension at the inlet end of the heat-fixing zone to filament tension at the outlet end of the heat-fixing zone is from 1:1.01 to 1:1.3.

In the stretch-texturing of polyamide-6 yarns, the filament temperature in the stretch-twisting zone is in the range from 145° to 185° C. and preferably in the range from 155° to 160° C. The degree of stretch for spinning material spun at 1000 meters per minute amounts to 1:2.6–1:3.3, preferably to 1:2.9–1:3.1. The degree of stretch is reduced by 0.1 for every 100 m/minute increase in the spinning rate.

In the case of polyester yarns, the filament temperature is from 150° to 210° C. and preferably from 170° to 190° C. In the case of spinning material spun at 1100 meters per minute, the degree of stretch amounts to from 1:3.1 to 1:3.75 and preferably from 1:3.4 to 1:3.5.

Where the spinning material has been spun at rates of 3200 meters per minute, the degree of stretch amounts to from 1:1.7 to 1:1.95 and preferably to from 1:1.79 to 1:1.87.

The process according to the invention is suitable for the simultaneous stretch-texturing of high-molecular-weight, linear synthetic endless filaments, more especially polyester and polyamide filaments.

Accordingly, the invention also provides stretch-textured polyamide filaments and polyester filaments with a snarl factor of less than 0.1 per kg and high tensile strengths of greater than 42 cN/tex and greater than 35 cN/tex, respectively. Another advantageous feature in the case of polyamide filaments is the maximum deviation of 15% in cold-water shrinkage. The polyester filaments are distinguished by a crimp stability of greater than 60%.

The advantages afforded by the process according to the invention are surprisingly manifold:

The yields, for example at a texturing rate of 500 meters/min., are higher by a few percent (less frequent filament breakage), and the improvement in yield is particularly noticeable in the case of non-optimal spinning material such as can occur from time to time as a result of faults in production.

One particular advantage is that the degree of stretch has to be reduced less for lower snarl factors, as a result of which it is possible to obtain higher tensile strengths for low snarl factors.

The crimp uniformity of the filaments at different points is considerably improved. This is a considerable advantage in terms of quality, especially for hosiery-grade deniers and the multisystem (for example eight-system) processing normally applied in their case. The frequency of faulty hosiery is greatly reduced. The boiling-induced shrinkage of the yarn is also reduced.

The process according to the invention is illustrated in the following with reference to FIG. 1 of the drawing which is a sketch showing that the filament travels from the spinning bobbin (1) through the filament guides (2) and the filament brakes (2*a*) to the delivery stage (3), consisting of the delivery roller (3*a*) and the rubber roller (3*b*). From the delivery stage, the unstretched filament enters the actual stretch-texturing zone, consisting of the heat-fixing element (4), the cooling zone (5), the twister (6), which is designed in the form of a friction twister for speeds in excess of 300 meters per minute, and the stretching godet (7) with an idler roller (7*a*), and is then wound into package form, optionally after passing a heat-set stage and another delivery stage. It is in the vicinity of the heat-fixing element that the filament twisted by the friction twister is stretched.

The distance between the delivery stage and the stretching godet (S) and the distance between the delivery stage and the twister inlet (LD) should be as short as possible. Since certain minimum heating-zone and cooling-zone lengths are required for fixing crimp, the minimum stretching-zone length is 55 cm and the minimum distance between the delivery stage and the twister inlet 40 cm. Very favourable results have been obtained with a stretching zone 100 cm. long with a distance between the delivery stage and the twister inlet of 85 cm for a texturing rate of 500 meters per minute and an approximately 1% application of spinning preparation.

The following measuring methods were used for determining machine conditions and the properties of the crimped yarns:

1. Yield: number of cops weighing, for example 2000 g wound without any breaks in the filament to the number of filaments applied.

2. Snarl factor: by measuring the capillary breaks/kg: snarl factors in excess of necessitated a reduction in the degree of stretch.

3. Strength testing: carried out for example with the snag-resistance tester according to DIN 53 834 (in cN/tex).

4. (a) Crimp uniformity: measuring cold-water shrinkage at different points. A 4400 dtex strand is kept for three minutes in water at 25° C. under a load of 90.3 mp/dtex, and the length $l_1$ of the strand is compared with the length of the strand after lessening the load to 1.8 mp/dtex ($l_2$) for a recovery period of 1 minute. The cold-water shrinkage CW is $$CW=(l_1-l_2/l_1)\cdot 100\%$$

(b) Crimp contraction and crimp stability: measured in accordance with DIN-Draft 53840: the stability load for determining crimp stability amounted to 1 p/dtex in the case of polyester and to 1.5 p/dtex in the case of polyamide-6.

The following Examples are to further illustrate the invention without limiting it.

EXAMPLE 1

A polyester filament with a final denier of 78 f 24 dtex, spun at a rate of 2700 meters per minute, was simultaneously stretched and textured at 400 meters per minute under the following conditions: distance from delivery roll to internal friction false-twister inlet 85 cm: total stretching zone length 100 cm: snarl factor 0.05/kg: stretching ratio 1:1.87. The temperature of the heat-fixing element was adjusted so that the filament temperature at the outlet end of the heat-fixing element was 180° C., whilst cooling of the filament between the heating element outlet and the twister inlet lowered the temperature of the filament to 86° C. up to the twister inlet. The twist imparted to the filament in the texturing zone amounted to 2990 turns/meter. After the stretching godet, the filament was set, before being wound into a package, at a temperature of 140° C. and with a shrinkage of 14%. Filament tension before the heat-fixing element was 13.0p and, after the heat-fixing element, 16.0p. The textured filament had a crimp contraction EK of 23%, a crimp stability of 64%, a tensile strength of 36 cN/tex, a breaking elongation of 39% and a boiling-induced shrinkage of 1.8%.

EXAMPLE 2

A polyamide-6 filament with a final denier of 44 f 10 dtex, spun at a rate of 1000 meters per minute, was simultaneously stretched and textured under the following conditions: length of stretching zone 100 cm: snarl factor less than 0.1/kg. The filament temperature in the fixing zone amounted to 155° C. and, at the twister inlet, to 72° C.; the stretching ratio was 1:3.0; tensile strength was 42–48 cN/tex at 44–38% elongation; mechanical crimp stability was 65%; cold-water shrinkage was 31%; and boiling-induced shrinkage was 5–7%. Of 100 cops, the lowest value for cold-water shrinkage was 27% and the highest 35%. Simultaneous processing with cops having CW-values of 27% and 35%, respectively, did not produce any so-called line effect in the hosiery.

In a parallel test of the same material carried out under the same texturing conditions, but with a stretching zone 3.5 meters long (same heating-rail length as in the case of a stretching zone 100 cm long), the degree of stretch had to be reduced to 1:2.64 on account of the increasing snarl factor: yarn strength amounted to only 28 Rkm, mechanical crimp stability to only 25%, whilst the cold-water contraction of 100 cops amounted on average to 35%, with one value at 23% and one value at 25%, three values at 28%, two values at 37% and one value at 39%. When processed into hose, cops with CW-values below 27% produced a distinct line effect, whilst cops with higher values than the average did not prove quite so critical. Accordingly, the uniformity of crimping from place to place was much poorer.

EXAMPLE 3

A polyamide-6 filament with a final denier of 22 f 5 dtex, spun at a rate of 900 meters per minute, was simultaneously stretched and textured at 700 meters per minute under the following conditions: length of stretching zone 100 cm: snarl factor less than 0.05/kg. The filament temperature at the heat-fixing element outlet was 155° C. and at the twister inlet 68° C. The stretching ratio was adjusted to 1:3.17. The filament had a tensile strength of approximately 44 cN/tex at about 38% elongation and a cold-water shrinkage of 41%. The yield from 10,000 tested cops was 94%.

By contrast, the yield fell to 87% when the length of the stretching zone, for the same material and with the same texturing conditions, amounted to 3.5 meters.

We claim:

1. A process for the stretch-texturing of high-molecular-weight, linear synthetic endless filaments travelling at speeds of from 300 to 1200 meters per minute at the stretching godet by the false-twist method by continuously guiding the filaments through a delivery zone, a heat-fixing zone, 30 to 70 cm. long between the delivery stage and the twister inlet, a false-twister and a stretching godet, wherein the filaments are passed through a stretching zone S 55 to 180 cm. long, defined by the distance between the delivery stage and the stretching godet, at a speed of from 300 to 1200 m/m, the distance between the delivery stage and the false-twister inlet amounting to S-X cm. and the distance X between the false-twister outlet and the stretching godet being from 5–30 cm.

2. A process as claimed in claim 1, wherein, after leaving the heat-fixing zone, the endless filaments travel through a 20 to 50 cm. long cooling zone formed by a contact cooler.

3. A process as claimed in claim 1, wherein, after leaving the heat-fixing zone, the endless filaments travel through a 3 to 15 cm. long cooling zone in which cooling is obtained by an air nozzle.

4. A process as claimed in claim 1, wherein the ratio of filament tension at the inlet end of the heat-fixing stage to filament tension at the outlet of the heat-fixing stage is from 1:1.01 to 1:1.3.

5. Simultaneously stretched and textured polyamide filaments produced by the process of claim 1 with a snarl factor of less than 0.1/kg for a strength of greater than 42 cN/tex and a deviation in cold-water shrinkage of at most 15%.

6. Simultaneously stretched and textured polyester filaments with a snarl factor of less than 0.1/kg and a strength of greater than 35 cN/tex and a mechanical crimp stability of greater than 60%.

* * * * *